US011331238B1

(12) United States Patent
Nady

(10) Patent No.: US 11,331,238 B1
(45) Date of Patent: May 17, 2022

(54) APPARATUS AND METHOD FOR CHANGING POSITION OF HOSPITAL PATIENT

(71) Applicant: Adam Nady, New York, NY (US)

(72) Inventor: Adam Nady, New York, NY (US)

( * ) Notice: Subject to any disclaimer, the term of this patent is extended or adjusted under 35 U.S.C. 154(b) by 0 days.

(21) Appl. No.: 17/478,895

(22) Filed: Sep. 18, 2021

(51) Int. Cl.
*A61G 13/12* (2006.01)

(52) U.S. Cl.
CPC ..... *A61G 13/1265* (2013.01); *A61G 13/123* (2013.01); *A61G 13/124* (2013.01); *A61G 13/125* (2013.01)

(58) Field of Classification Search
CPC ..... A61F 5/0585; A61F 5/0111; A61F 5/01; A61F 13/04; A61F 5/05883; A61F 5/3776; A61G 1/01; A61G 1/04; A61G 1/044; A61G 13/1265; A61G 13/123; A61G 13/124; A61G 13/125
See application file for complete search history.

(56) References Cited

U.S. PATENT DOCUMENTS 3,420,574 A * 1/1969 Smith ..... A47C 4/54 297/452.41
6,230,350 B1 * 5/2001 Goldstein ..... A47C 20/026 5/636
6,256,817 B1 7/2001 McGuire et al.
7,228,579 B2 * 6/2007 Tidwell ..... A61B 6/0421 378/209
7,406,723 B2 8/2008 Davis
7,536,734 B2 * 5/2009 Heimbrock ..... A61G 7/0755 5/602
7,607,185 B1 10/2009 Minson
7,849,859 B2 * 12/2010 Bochner ..... A61G 13/0009 128/845
8,332,977 B2 12/2012 Bochner et al.
8,850,634 B2 10/2014 Ponsi et al.
8,875,327 B2 11/2014 Gilley et al.
11,026,853 B2 6/2021 Hillenbrand, II et al.
2002/0166168 A1 * 11/2002 Weedling ..... A61G 7/103 5/81.1 R
2007/0028380 A1 2/2007 Russo et al.
2007/0028388 A1 2/2007 Fletcher
2011/0094040 A1 * 4/2011 deGreef ..... A61G 7/05776 5/713
2013/0055504 A1 3/2013 Peash et al.
2013/0318717 A1 12/2013 Iheoma
2015/0327740 A1 11/2015 Edwards et al.

* cited by examiner

*Primary Examiner* — Ophelia A Hawthorne
(74) *Attorney, Agent, or Firm* — Walter J. Tencza, Jr.

(57) ABSTRACT

A soft, inflatable, single use, repositioning device for ob/gyn/pelvic examination and procedures, more particularly, to single time use and/or partially reusable pillow like device. A flat collapsible/inflatable-expandable, repositioning and lifting apparatus for medical and ob/gyn examination and procedures and, more particularly, to a reposition and lift device, with a single or more than one, inflatable compartment. Various attachments may be provided, such as foot stirrups, sleeves, and handles, and optional accessories, with built in compressed gas cartridge, and/or a reusable pump for air source through connector. The device repositions, orient and raises the patient's lower back and the buttocks from supine, flat position to dorsal lithotomy and Trendelenburg position on a flat hospital bed to carry out an exam or a procedure, without moving a patient to a special exam room or using another table.

30 Claims, 12 Drawing Sheets

APPARATUS AND METHOD FOR CHANGING POSITION OF HOSPITAL PATIENT

FIELD OF THE INVENTION

The present invention relates to a patient repositioning device for medical examination and procedures.

BACKGROUND OF THE INVENTION

There are various known methods and apparatuses for changing the position of a patient and generally only a few of these existing methods and apparatuses are intended to facilitate specialty exams like pelvic or gynecological exams, while the patient is lying supine on a regular bed or table and without moving the patient to a special exam room. More importantly, none are single patient/one-time use.

Patient positioning in the medical field is important and depends on the medical specialty, the type of exam and the procedure for that patient. During a pelvic/ob/gyn exam and procedure, the patient needs to be placed in a special position called dorsal lithotomy, with or without Trendelenburg position. In this position, knees and hips are bent and spread apart/abducted, the buttocks are elevated and placed at the edge of a special table designed for such positions. For adequate pelvic/gynecological/obstetric exam or procedure and/or during birthing, lithotomy or dorsal recumbent position is required. Performing a pelvic, gynecological, and/or rectal exam or procedure and/or giving birth, while the patient is lying supine on the hospital bed, is not suitable, becomes very challenging, unsafe, and difficult for the health care provider to perform adequately, efficiently, and safely. In addition, it can be very uncomfortable and unsafe for patients or for a baby during delivery. Therefore, the patient needs to be repositioned/oriented into a dorsal/recumbent lithotomy position and buttocks should be elevated above the mattress level.

When an urgent pelvic/gynecological examination needs to be done on a regular bed, the lithotomy position is essential since it allows the health care provider access to the intended part of the body (vagina, perineum and/or anal canal) for medical examination and for performing a medical procedure and/or delivery of a baby. Elevating the buttocks above the hospital bed mattress allows space for a medical instrument to be inserted and for a medical procedure to be performed efficiently and is more comfortable for a patient.

Current practice for achieving and performing the gynecological/pelvic exam and/or procedure on a regular hospital bed, is either transporting the patient from her/his room to a room equipped with such a special table, or by changing the patient position by placing a bed pan or regular bed pillows, underneath the patient's lower back in order to elevate the pelvis and the buttocks area to get some exposure. This maneuver is very uncomfortable, inadequate and difficult for the patient to maintain, and challenging to the health care provider to perform the intended exam and procedure, since it doesn't achieve enough elevation for the necessary exposure to perform an adequate exam and/or procedure in a safe manner. In addition, in an emergency situation, such as imminent childbirth, there is no time to transport the patient to a special exam table, which is only available in a few locations in the hospital, and the delivery must be completed on that bed. Furthermore this difficult maneuver, using bed pan, carries a risk for the patient, especially if they are obese or suffer back problems.

During laparoscopic and robotic assisted laparoscopic procedures, steep Trendelenburg position required and occurs when the patient is in a supine or dorsal lithotomy position, and the patient is tilted between fifteen to thirty degrees from horizontal, where the head of the patient is below the feet, the buttocks, and the pelvic level. The Trendelenburg position is important and required during laparoscopy/robotic surgery. Such a position, using the advantage of gravity, allows the bowels to move/shift to the upper abdomen, to improve the exposure and visualization of the pelvic organs during surgery and to operate safely. Some patients cannot tolerate such a steep tilt due to medical conditions, especially when they are obese.

Both positions, lithotomy and Trendelenburg, require special tables designed to accommodate the patient's position for the gynecological/pelvic medical exam or medical procedure. These tables are usually expensive, bulky, heavy, and occupy extra space. In addition, they need to be in a designated area in the hospital, such as outpatient gynecological examination room, delivery room and/or procedure/operating room.

Such an inexpensive, preferably single use device is needed to achieve the exam while the patient is lying on his/her hospital bed, especially during an emergency situation and when there is no time to transport the patient to a special/labor room. Such a proposed device will be essential and needs to be available/accessible for use on the hospital floors, areas like radiology and urology's departments, during laparoscopic/robotic surgery, at an urgent care facility, nursing home, and can be a safer alternative for underdeveloped low resource countries who can't afford purchasing these special exam tables and/or make it available in all rural areas.

SUMMARY OF THE INVENTION

In at least one embodiment, the present invention provides, a pneumatic/inflatable repositioning elevating apparatus, which is configured to be placed when collapsed and before being inflated, as a flat double layer sheet that slides underneath a patient's lower back and buttocks. The pneumatic/inflatable apparatus inflates after connection to the air source device, so that it raises the patient's buttocks and lower back for repositioning the patient to achieve the required lithotomy/Trendelenburg position while the patient is lying on her/his hospital bed. Similarly, during robotic assisted laparoscopic procedures, a combination of a mild Trendelenburg position with one or more embodiments of the present invention, achieves and replaces the purpose of a steep Trendelenburg tilting without compromising a patient's health.

In at least one embodiment, an apparatus of an embodiment of the present invention may include at least three parts:

Part (1): Disposable/one-time use, inflatable apparatus. The inflatable apparatus, in at least one embodiment is a rectangular wedge-shaped device. In operation, the inflatable apparatus is put in a deflated state, and placed, in one example, on a table or bed. The inflatable apparatus may be placed on the table or bed, when in a deflated state, by sliding underneath the buttocks and lower back of a patient. The patient may lie down on the inflatable apparatus (which is deflated), so that the inflatable apparatus is underneath the buttocks and lower back of the human patient.

With the patient lying down flat in supine position, with the inflatable apparatus underneath the buttocks and lower back of the patient in a deflated state, the inflatable apparatus is inflated, such as by a pump, to thereby reposition and elevate the patient's buttocks and lower back. The patient's position is changed from supine, the deflated state of the apparatus, to the dorsal lithotomy and elevating buttocks, the inflated state of the apparatus. When the apparatus is in the fully inflated state, the patient position changes from supine to recumbent dorsal lithotomy/Trendelenburg position without moving the patient to a special exam table.

The Inflatable apparatus in at least one embodiment, has a concave curvature at its base, when slid underneath the buttocks and lower back of a patient, while the patient is lying supine on a table or bed, the inflatable apparatus repositions and elevates the buttocks and perineum area above the mattress into a dorsal lithotomy position. This concave curvature allows a space free area for the provider to accommodate the speculum and instruments and the health care provider's hands to perform the particular medical exam, procedure and/or enough space for delivering a baby.

The inflatable apparatus may have a handle at each side, including a left and right handle. The left and right handles of the inflatable apparatus may be used to assist in sliding and positioning the deflated apparatus underneath the body of a patient, such as underneath the buttocks and/or lower back by a health care provider. The left and right handles of the inflatable apparatus may also be used by the patient when the inflatable apparatus is fully inflated to maintain the orientation and/or position of the human patient for stability and to maintain the patient's balance.

In at least one embodiment, there are foot sleeve stirrups at each side of the base of the inflatable apparatus attached to the inflatable apparatus, which may be attached by adjustable length straps and/or belts. When the patient places both feet into corresponding sleeves, this helps maintain the patient's hips and knees in a flexed orientation or position and helps keep the thighs abducted and stabilizes the patient in dorsal lithotomy position during the medical exam, procedure, or delivery of a baby, while the patient is grasping on the handles, with two corresponding hands.

Part (2): A reusable accessory apparatus, like a tray, which may be optional, is configured to be used with the inflatable apparatus to assist in placing the deflated apparatus, after the deflated apparatus is attached to the reusable tray and/or accessory apparatus. The accessory apparatus helps in sliding the inflatable apparatus underneath the human patient and as a tray for medical instruments and as extra support for the inflatable apparatus on the bed or the table.

The reusable accessory tray apparatus and related components is configured, in at least one embodiment, with extendable, telescopic, retractable foot supports from the accessory tray apparatus. The accessory apparatus, in at least one embodiment, is configured to be supplied with built in or removable light sources.

Part (3): Reusable compact portable rechargeable/or wired high-pressure air pump and connecting hose to connect to and inflate the inflatable apparatus.

The inflatable apparatus can be made in a variety of shapes and designs from a simple single compartment wedge, square, round, rectangular, or in combination. The inflatable apparatus, in at least one embodiment, may be configured with single or multiple compartments. The inflatable apparatus may have a molding shape to fit the patient's body, such as with cushion wings at the side, and/or shoulder support to keep the patient in place.

The inflatable apparatus can be made with an integrated/built in air source/pump, or with a connector to accommodate a single use compressed air cartridge, to inflate the apparatus when the apparatus is ready to be inflated.

The apparatus can be manufactured from a variety of material, single/one-time use (disposable), or reusable material with a disposable apparatus cover, as a fully foldable device or with a flat firm hard bed side layer and inflatable soft patient side layer. Single/one-time use (disposable) is preferable to avoid cleaning/sterilization if used more than one time and to prevent the risk of transmission of infection between patients.

The inflatable apparatus part (1) may alternatively be configured in different shapes, such as wedge, and/or rectangular shape, although wedge shaped is preferred. The inflatable apparatus may come in multiple sizes such as small, large and/or extra-large, with different heights.

The inflatable apparatus part (1), in at least one embodiment, is configured to be inflated to more than one height setting to accommodate the patient comfort, adjust the buttocks elevation, and to give the health care provider the required space to access the area for medical exam/procedures.

The inflatable apparatus part (1), in at least one embodiment of the present invention an advanced configuration may be provided, in addition to lower body molding fitting design, which is configured to have plurality of external inflatable compartments, may include inflatable side cushions, inflatable thigh rests, and an inflatable back and/or shoulder support.

The inflatable apparatus part (1), in at least one embodiment of the present invention an apparatus is provided comprising: a body portion having an outer housing and a first inner chamber within the outer housing; a left foot retaining device attached to the outer housing of the body portion; and a right foot retaining device attached to the outer housing of the body portion; and wherein body portion is configured to allow the first inner chamber to be filled with air to inflate at least part of the body portion.

The inflatable apparatus part (1), in at least one embodiment, the apparatus further includes a left handle attached to the body portion at a first side of the body portion; and a right handle attached to the body portion at a second side of the body portion which is opposite the first side of the body portion.

The body portion when fully inflated may have a wedge shape. The body portion when fully inflated may have a front with an indented section. In at least one embodiment, the left foot retaining device includes an adjustment device for adjusting a distance of the left foot retaining device from the body portion; and the right foot retaining device includes an adjustment device for adjusting a distance of the right foot retaining device from the body portion.

The inflatable apparatus part (1), in at least one embodiment, the body portion includes a left side wall, a central section, and a right side wall, with the central section in between the left side wall and the right side wall.

The inflatable apparatus part (1), in at least one embodiment, the body portion includes a second inner chamber separate from the first inner chamber, wherein the second inner chamber is configured to be filled with air to inflate at least part of the body portion.

The optional accessories tray device (part 2) may include a built in foldable light source on one side of the tray, and extendable/retractable footrest support system built into both sides of the device tray.

In at least one embodiment of the present invention, a method is provided which includes locating a body portion of an apparatus in a first location in which the body portion is under the back and buttocks of a person, and between the person and a support structure, table or hospital bed, while the person is lying down on the body portion, which is located on the support structure; and by inflating at least part of the body portion while the body portion is located in the first location, this will change the orientation and reposition of that person to intended exam position. The apparatus may be constructed as previously discussed.

DETAILED DESCRIPTION OF THE DRAWINGS

Figure 1:
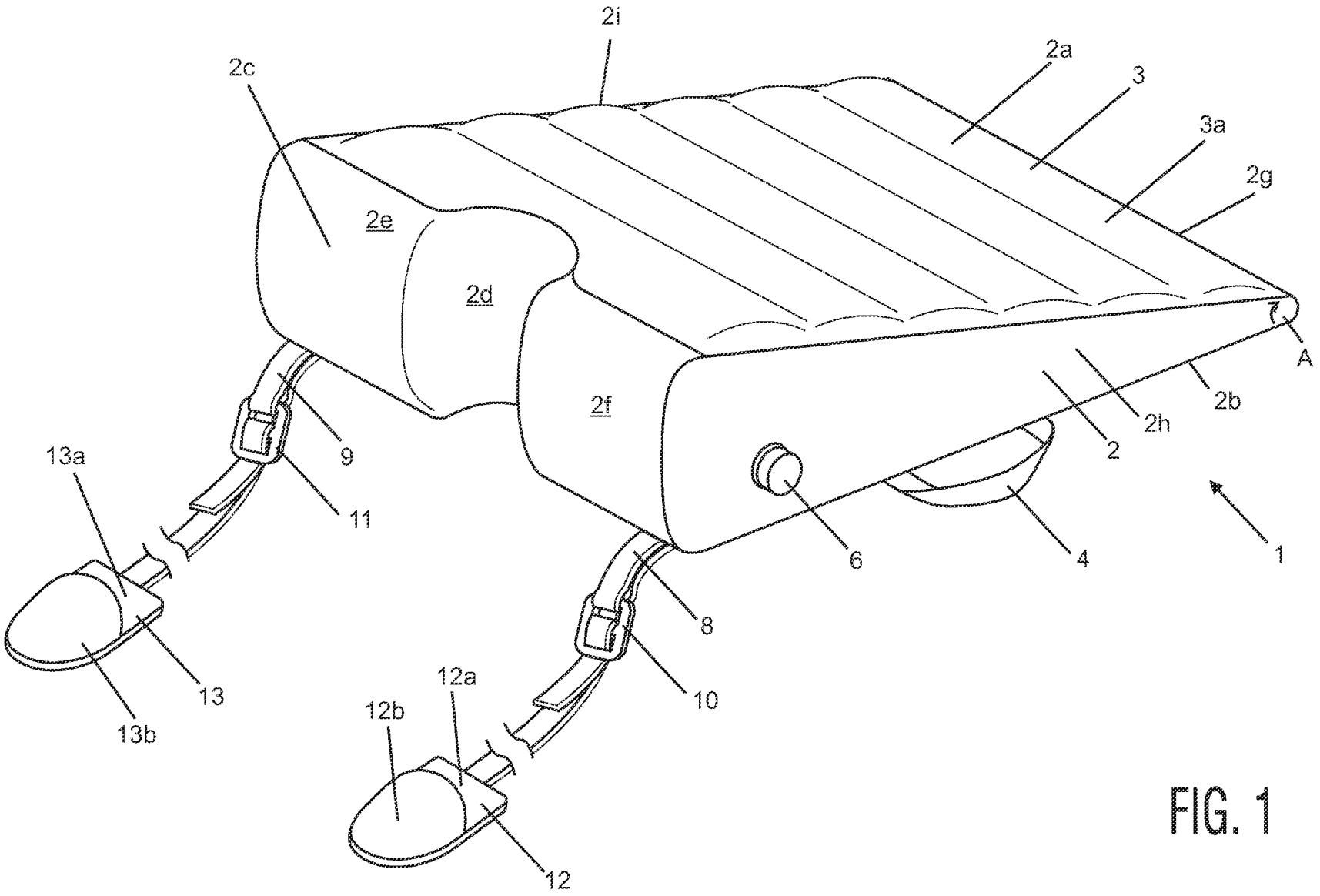
FIG. 1 is a top, front, and left (viewed from the patient's perspective) perspective view of an apparatus in accordance with an embodiment of the present invention, with the apparatus of FIG. 1 shown in an inflated state.

FIG. 1 is a top, front, and left perspective view of an apparatus 1 in accordance with an embodiment of the present invention, with the apparatus 1 of FIG. 1 shown in an inflated state.

The apparatus 1, in at least one embodiment, includes a body portion 2, a left handle 4, a right handle 5 (shown in FIG. 2), a capped inlet port 6, a strap 8, a strap 9, a buckle 10, a buckle 11, and stirrup or foot reception devices 12 and 13. The body portion 2 may be an inflatable apparatus.

The body portion 2 may be made of an inflatable apparatus or container having an inner chamber which can be filled with air to fully inflate the body portion 2 to the fully inflated state (or substantially fully inflated state), shown in FIG. 1. The body portion 2 may have an outer skin or covering which completely seals in the inner chamber, except when a cap is removed from the capped inlet port 6. When the cap is removed from inlet port 6, air can be provided through the inlet port 6, and into the inner chamber of the body portion 2. The inner chamber of the body portion 2 may be made of any soft foldable material suitable for holding in air, such as material used for water rafts or water beds. The skin cover may be made of soft anti slip velour surface.

The body portion 2 may also be made of a single inflatable chamber, fully foldable, of any soft material suitable for holding in air, such as the material used for water rafts or water beds. The body portion 2 may also be made of a single inflatable chamber with the bottom of the device can be made in a double layer to include a sleeve made with a non-inflatable soft material to host a hard board, hard board material can be plastic, that if inserted inside the sleeve will give support to the bottom side, as shown, for example in FIG. 12.

The body portion 2 may also be made as non-foldable, with one soft side, the top patient side, and one flat firm bed side, the bottom side.

The body portion 2 is configured, in at least one embodiment, so that when fully or substantially fully inflated, the top surface 2*a* of the body portion 2 makes a 1-inch curve angle A with the body surface 2*b* of the body portion 2. In at least one embodiment, it is preferred that this angle A to be between 17.00-17.75 degree, in order to properly reposition or orient and elevate a person's pelvis such as the person 110, for a gynecological/pelvic medical examination or procedure or during labor, while lying in supine position on the hospital bed as shown, for example in FIG. 5.

Figure 6:
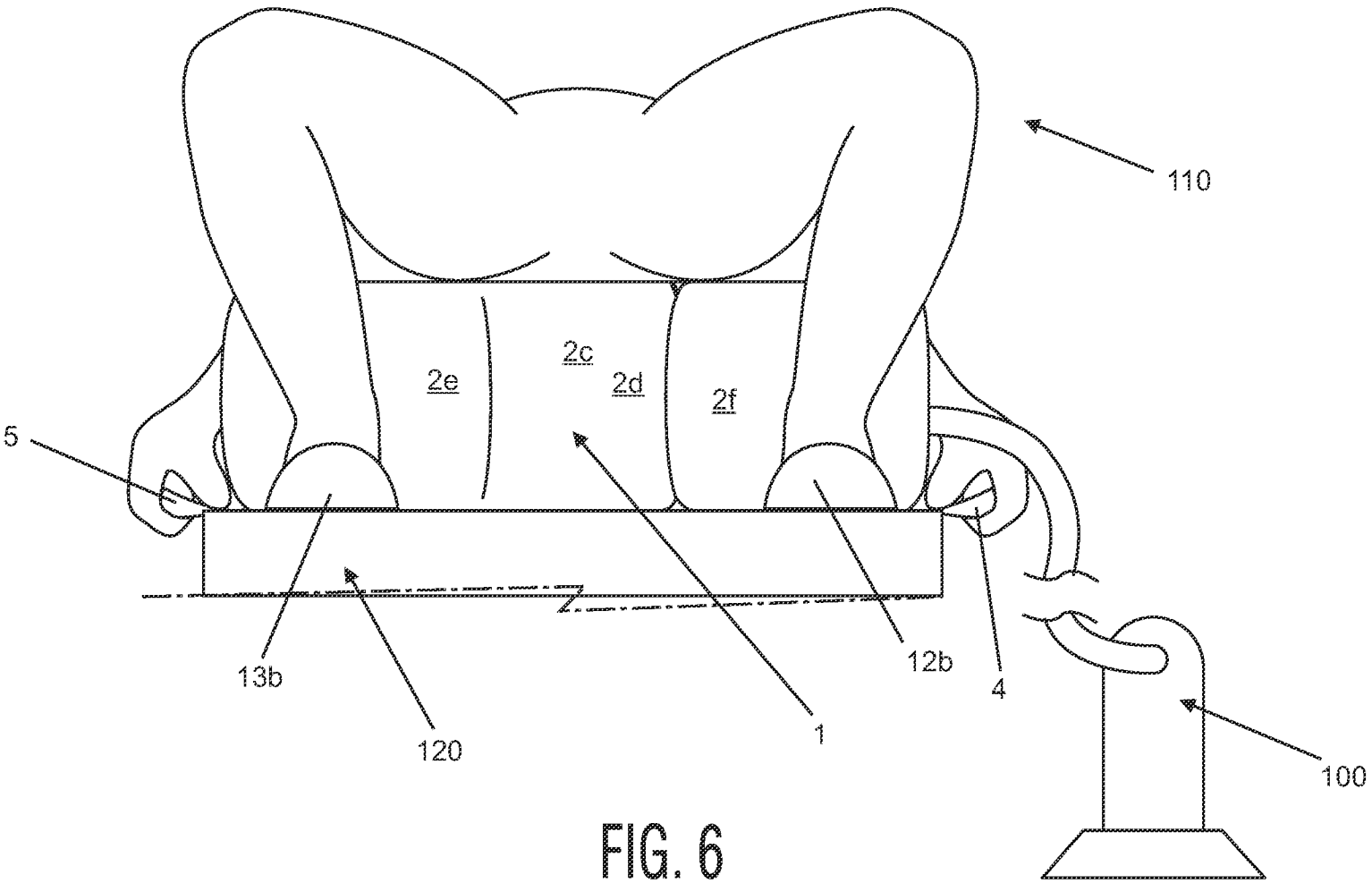
FIG. 6 is a front view of the apparatus of FIG. 1 in the inflated state, and with the person lying on the apparatus of FIG. 1, which is lying on the hospital bed and wherein the apparatus of FIG. 1 is inflated and connected to the pump.
Figure 10:
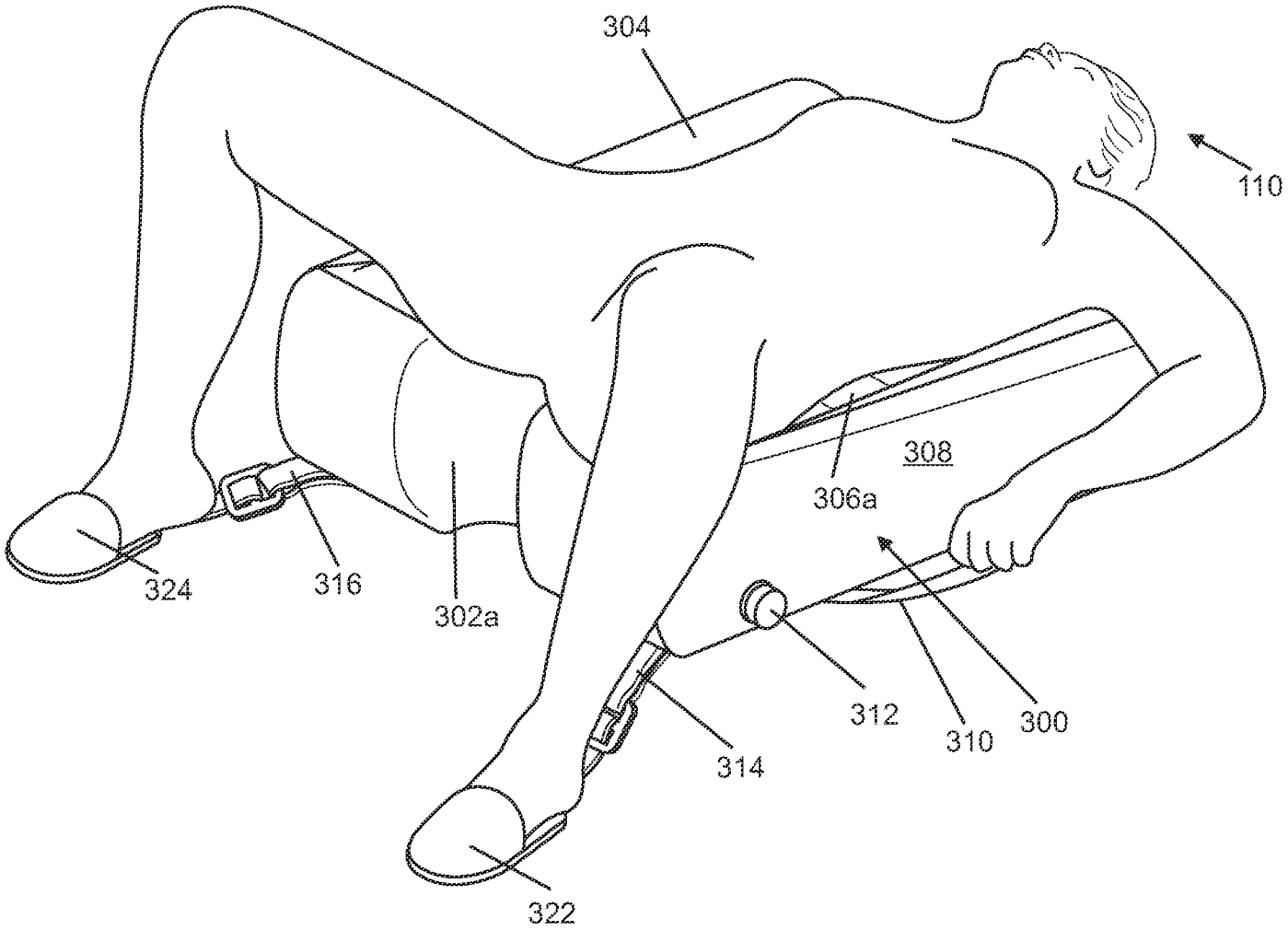
FIG. 10 is a top, front, and left side perspective view of the person lying on the second modified apparatus of FIG. 9 which is in the inflated state.

The body portion 2, has a front 2*c* which includes portions 2*e*, 2*d* and 2*f*. The portion 2*d*, curvature part, is indented to provide space free area for easier medical examination or procedure of a person, particularly a gynecological medical examination of a biological female person as shown by FIG. 6 and FIG. 10 (for a second further apparatus 300, which is similar in regard to an indented section 302*a* similar to indented section 2*d*.

Referring to FIG. 1, the body portion 2 has a left side 2*h*, a right side 2*i*, and a back 2*g*. The body portion 2 includes a plurality of ridges 3, including ridge 3*a* on the top surface 2*a* to provide comfort and to aid in preventing a patient, such as patient 110 shown in FIG. 5, from sliding or moving substantially while lying on the apparatus 1, while the apparatus 1 is inflated and lying on a table 120 or bed. The body portion 2 may be made in more than one size and to fit more than one patient's size, such as small, large, extra-large, and extra-extra-large. For example, the body portion 2, large size, the length may be 25.0 inches for bottom, 26.25 inches for top, 24.0 inches for width and 8.0 inches for front height, one inch for the back, to achieve the angle A of approximately 17.75 degrees.

The left stirrup 12 includes a flat portion 12*a* for the bottom left of the patient 110's left foot to rest on, and a covering portion 12*b*, for holding the left foot to prevent it from moving. Similarly, or identically, the right stirrup 13 includes a flat portion 13*a* for the bottom right of the patient 110's right foot to rest on, and a covering portion 13*b*, for holding the right foot to prevent it from moving. The first/left foot lies substantially between the flat portion 12*a* and the covering portion 12*b*, while the second/right foot lies substantially between the flat portion 13*a* and the covering portion 13*b*.

The straps 8 and 9, and corresponding buckles 10 and 11, allow the distance between the stirrups 12 and 13 and the body portion 2, to be adjusted for various lengths to accommodate different patient heights. The adjustment provided by the buckles 10 and 11 helps a patient, such as person 110, to keep both knee and hip joints in a flex position during a medical exam.

Figure 11:
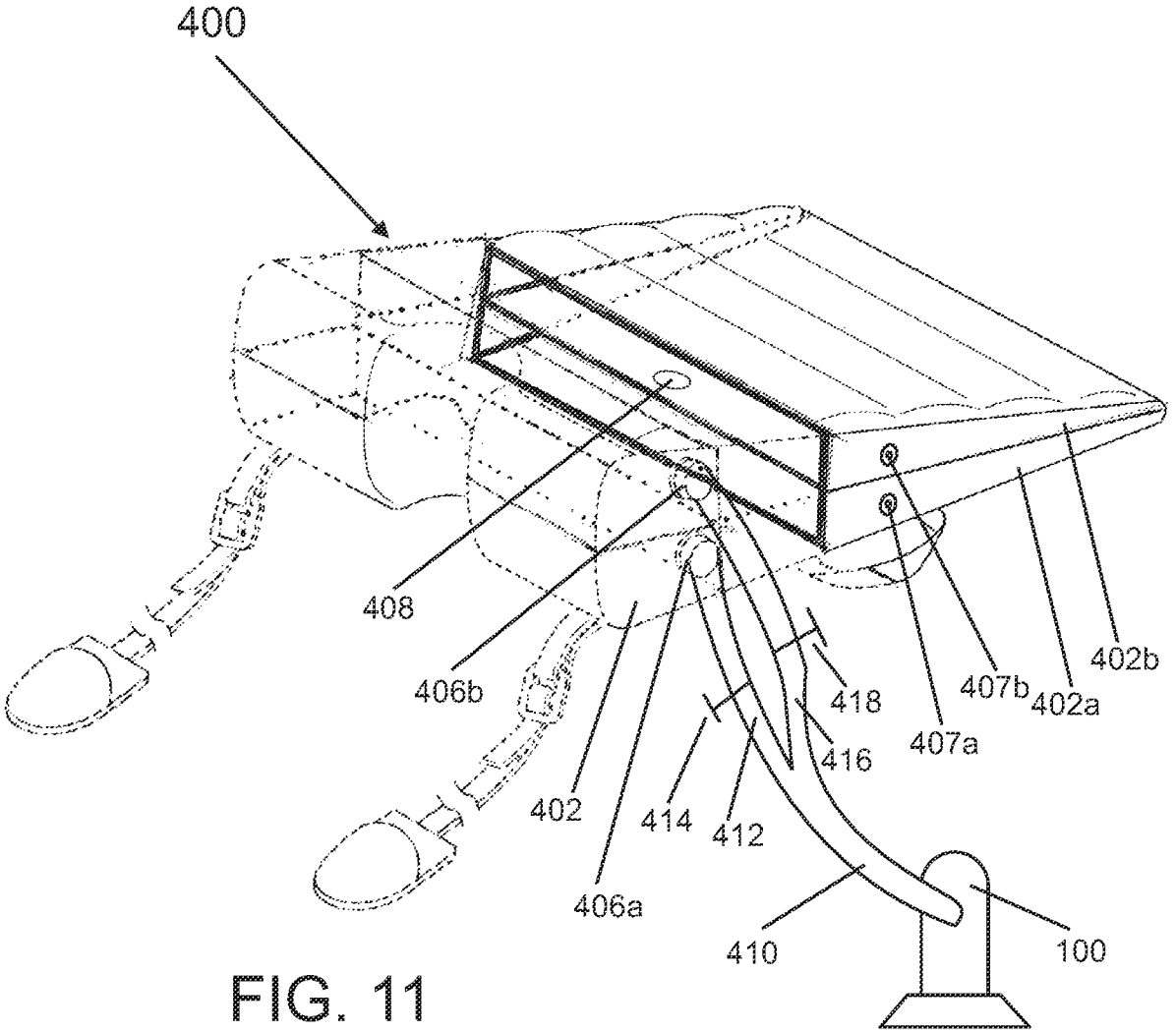
FIG. 11 is a top, front, and left (viewed from the patient's perspective) perspective view of an apparatus with multiple bladders in accordance with another embodiment of the present invention, with the apparatus of FIG. 11 shown in an inflated state.

The body portion 2 of the apparatus 1, in at least one embodiment, may be made of single or multiple horizontal bladders, compartments, or chambers, such as for the two bladders shown for the apparatus 400, which is made of first bladder, compartment or chamber 402*a* and second bladder, compartment or chamber 402*b* shown in FIG. 11.

For apparatus 400, (or for an identical apparatus for body portion 2 made of two or more chambers) the chambers, such as 402*a* and 402*b* of the body portion 402 may be inflated, spontaneously or sequentially, from a single external valve. When the chambers 402*a* and 402*b* are inflated sequentially, air will flow from a lower chamber, such as 402*a* when completely inflated, to an upper chamber, such as 402*b*, through an internal one-way valve located, such as 408, located in a separating divider between the chambers 402*a* and 402*b*. The valve 408 opens at set pressure which is typically equivalent to the pressure in the completely inflated lower chamber, as shown, for example in FIG. 11.

The body portion 2, and/or the body portion 402 shown in FIG. 11, when made of two or more chambers (such as chambers 402*a* and 402*b*), may be inflated using a separate external valve/cap, such as through caps 406*a* and 406*b*, and may be attached to individual tubes, such as tubes or branches 412 and 416 with corresponding shut-off valves 414 and 418 number for each inner chamber of chambers 402*a* and 402*b* of body portion 402 to inflate each chamber separately. The tubes 412 and 416 merge to a single tube 410 coming from the single air source or pump 100.

Figure 12:
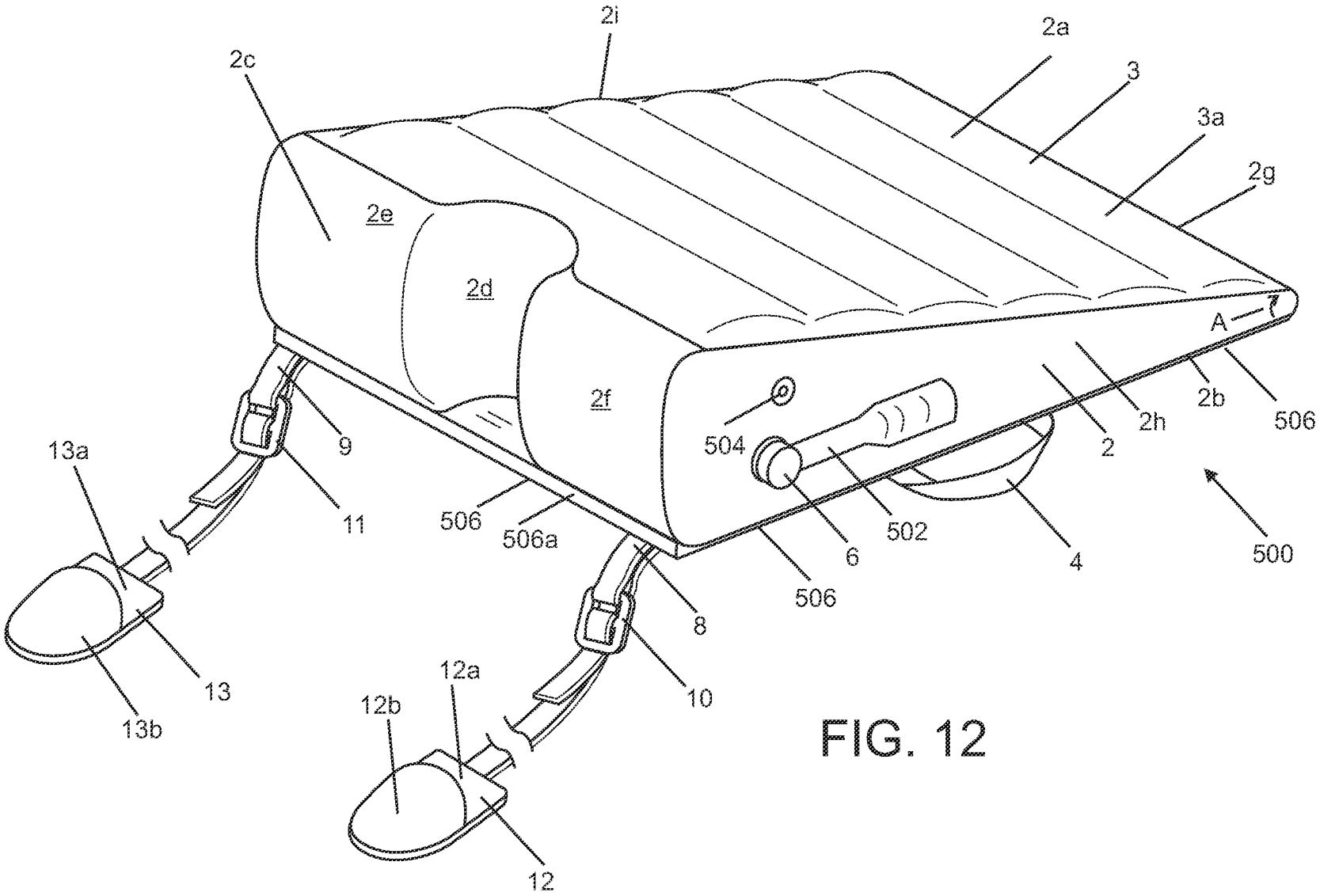
FIG. 12 is a top, front, and left (viewed from the patient's perspective) perspective view of an apparatus in accordance with another embodiment of the present invention, with the apparatus of FIG. 12 shown in an inflated state.

The bladder chambers, such as 402*a* and 402*b*, may be inflated from an integrated compressed air source cartridge, or a single use cartridge can be connected to each chamber, such as single use cartridge 502 shown in FIG. 12 for apparatus 500, which can also be used for apparatus 1 and apparatus 400.

The air source from the integrated cartridge 502 or the external pump 100 may have pressure devices or setups for automatic cut off pressure to stop inflation at pressure equivalent to the pressure when the apparatuses 1, 300, 400, and/or 500 are fully inflated. Pressure devices or setups are typically adjusted from commercially used external pump and typically would be determined by a pump manufacture company according to the material of the apparatuses 1, 300, 400 and/or 500 and body weight of the person that the inner chamber of the particular body portion, such as body portion 2, can hold while inflated.

The inflatable apparatus's chamber in the body portion 2 may contain external safety valve/valves, such as valves 407*a* and 407*b* for the apparatus 400, FIG. 11, to allow the air to escape when the pressure exceeds maximum inflation pressure and to deflate the apparatuses 1, 300, 400, or 500 after being used.

Figure 2:
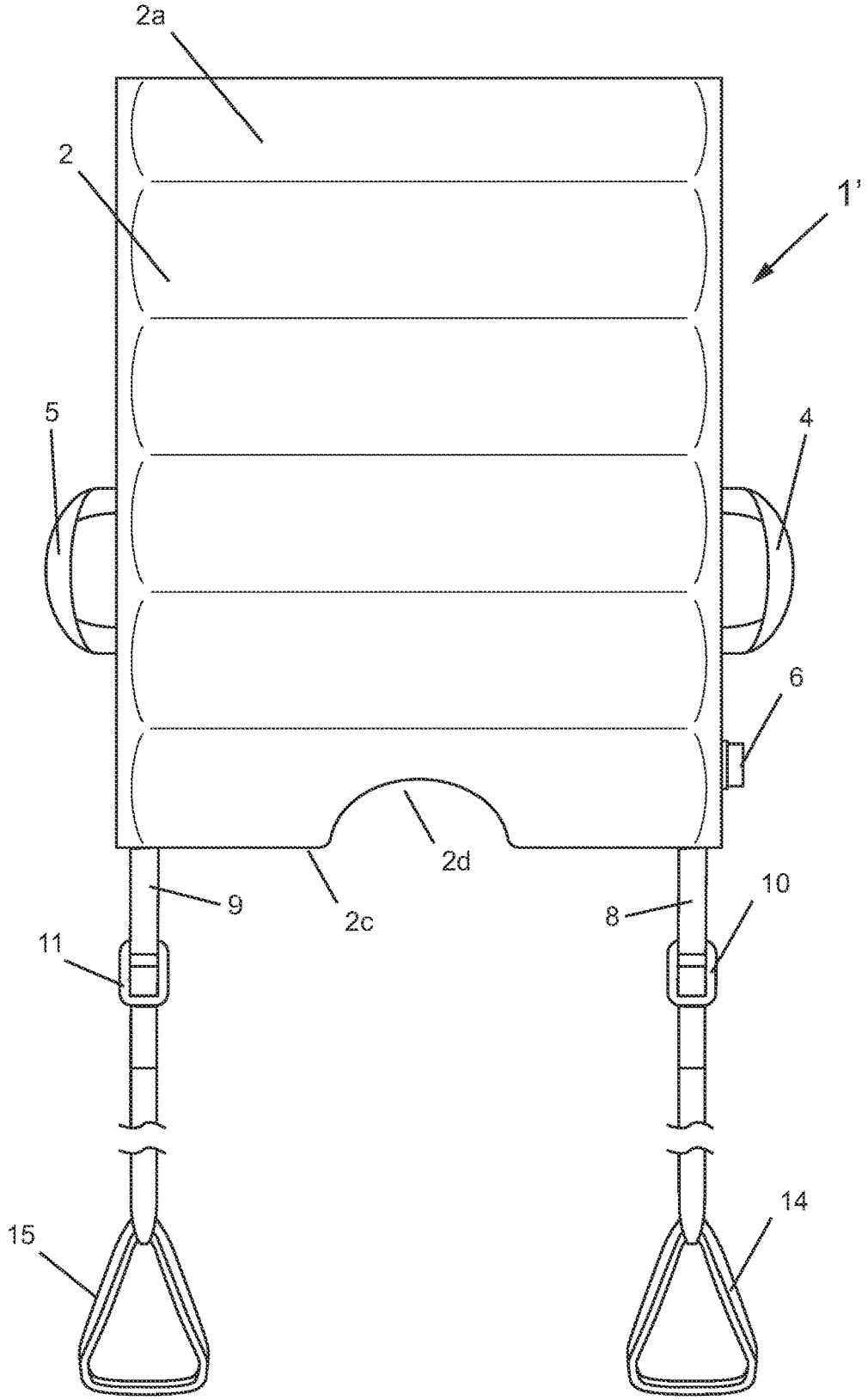
FIG. 2 is top view of a modified apparatus in accordance with an embodiment of the present invention, which has been modified somewhat from FIG. 1 embodiment, with the modified apparatus of FIG. 2 shown in an inflated state.

FIG. 2 is the top view of a modified apparatus 1' in accordance with an embodiment of the present invention, which has been modified somewhat from the apparatus 1, with the modified apparatus 1' of FIG. 2 shown in an inflated state. The modified apparatus 1' has loops 14 and 15, instead of stirrups 12 and 13, respectively as in apparatus 1. The modified apparatus 1' is otherwise the same as the apparatus 1.

Figure 3:
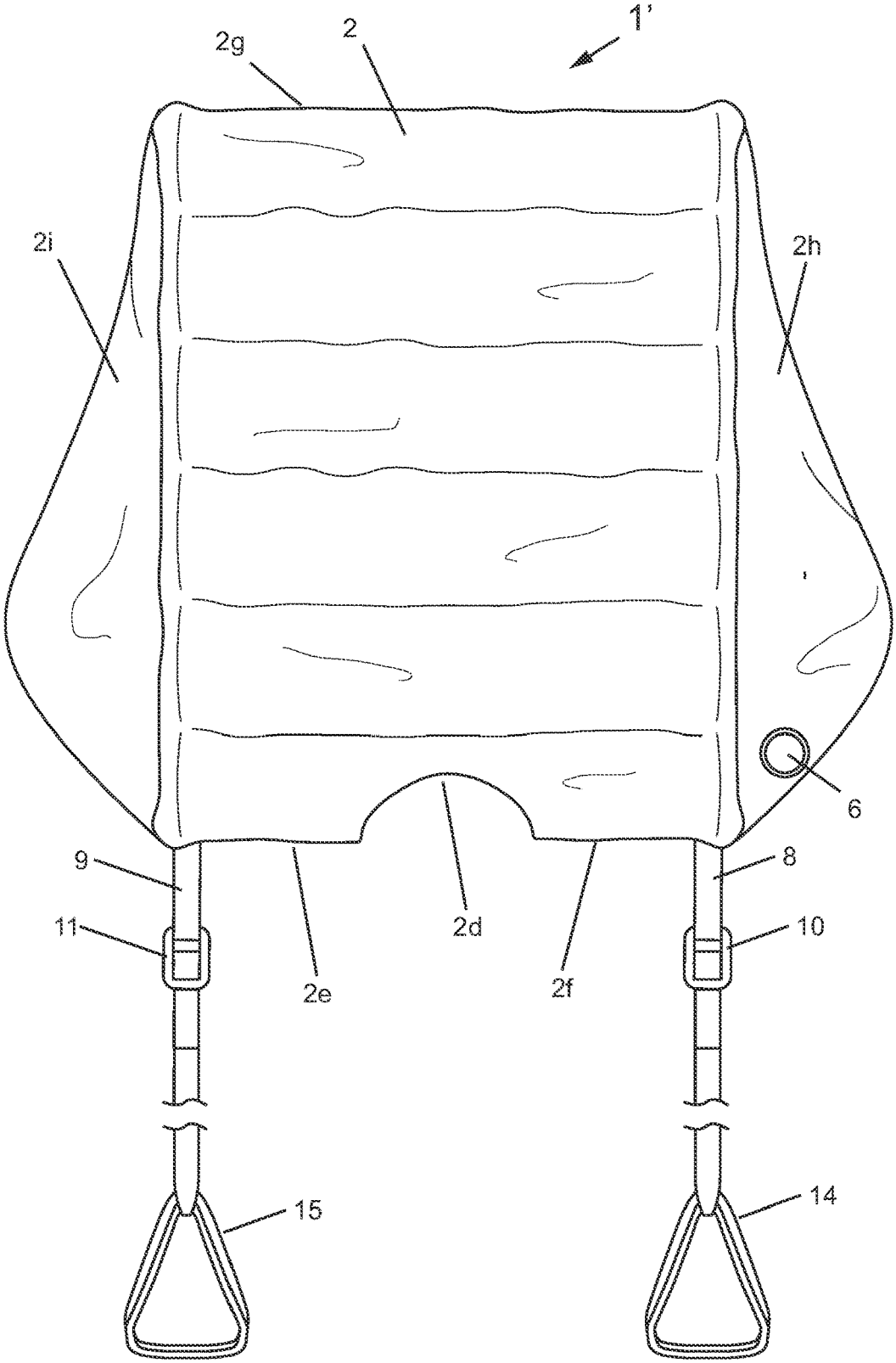
FIG. 3 is a top view of the modified apparatus of FIG. 2, which is the modified apparatus shown in a deflated state.

FIG. 3 is a top view of the modified apparatus 1', wherein the modified apparatus 1' is shown in a deflated state. In FIG. 3, the walls or sides 2*i* and 2*h* are shown collapsed because the modified apparatus 1' is deflated.

Figure 4:
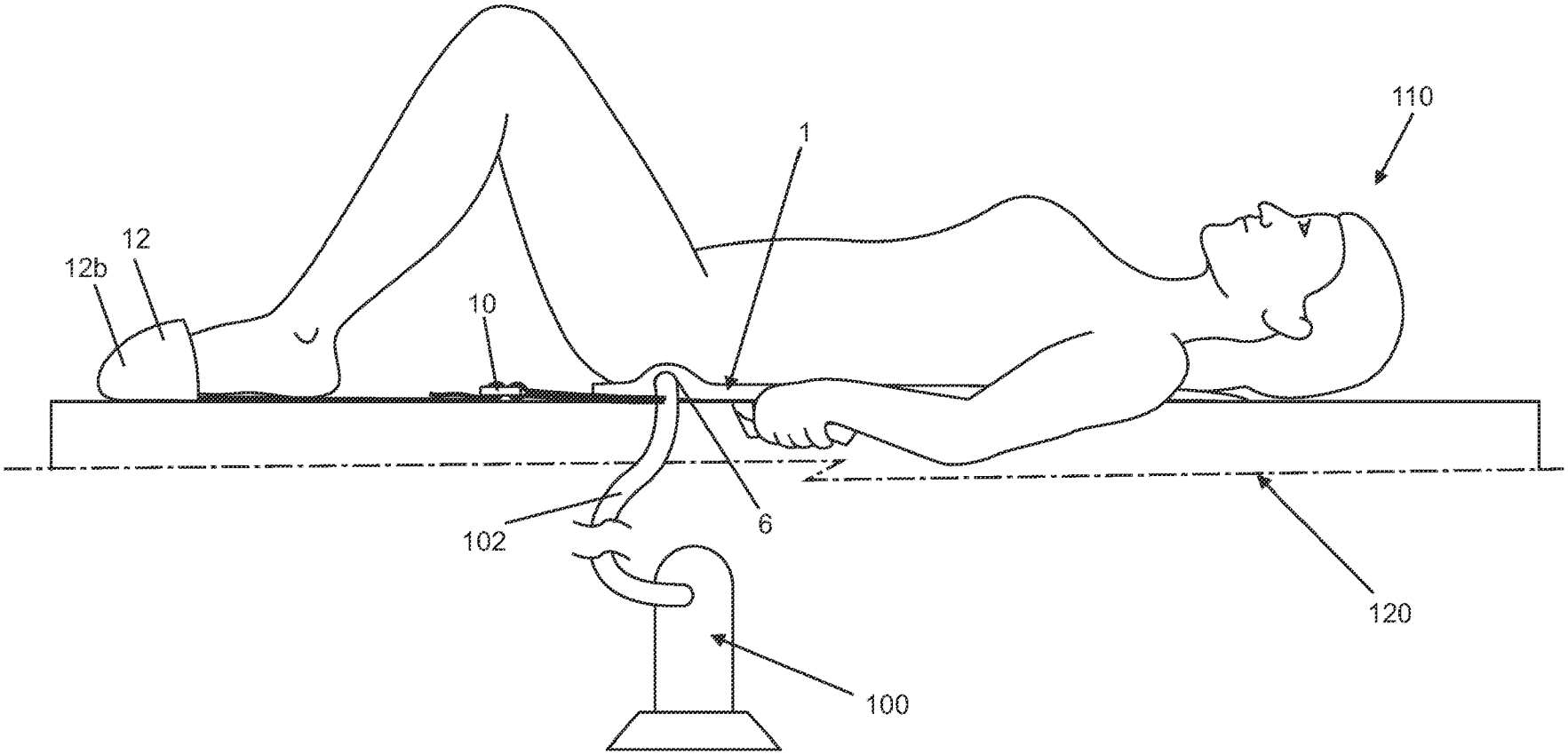
FIG. 4 is a left side view of pump, and a left side view of a human being lying supine on the apparatus of FIG. 1, which is in a deflated state and which is lying on a hospital bed in supine position.

FIG. 4 is a left side view of pump 100, and a left side view of a biological female person 110 lying flat/horizontal on the apparatus 1 of FIG. 1, which is in a deflated state, and which is lying flat/horizontal on a hospital bed or table 120. The pump 100 has a tube 102 which is connected to the input port 6 (with the cap removed), in order to fill the inner chamber of the body portion 2 with air to inflate the body portion 2. In FIG. 4 The human being or person 110's left hand is holding onto the left handle 4 of the apparatus 1; the left foot of the person 110 is inside the left foot's strap or stirrup 12 keeping the knee and the hip of the person 110 in the flexion position.

Figure 5:
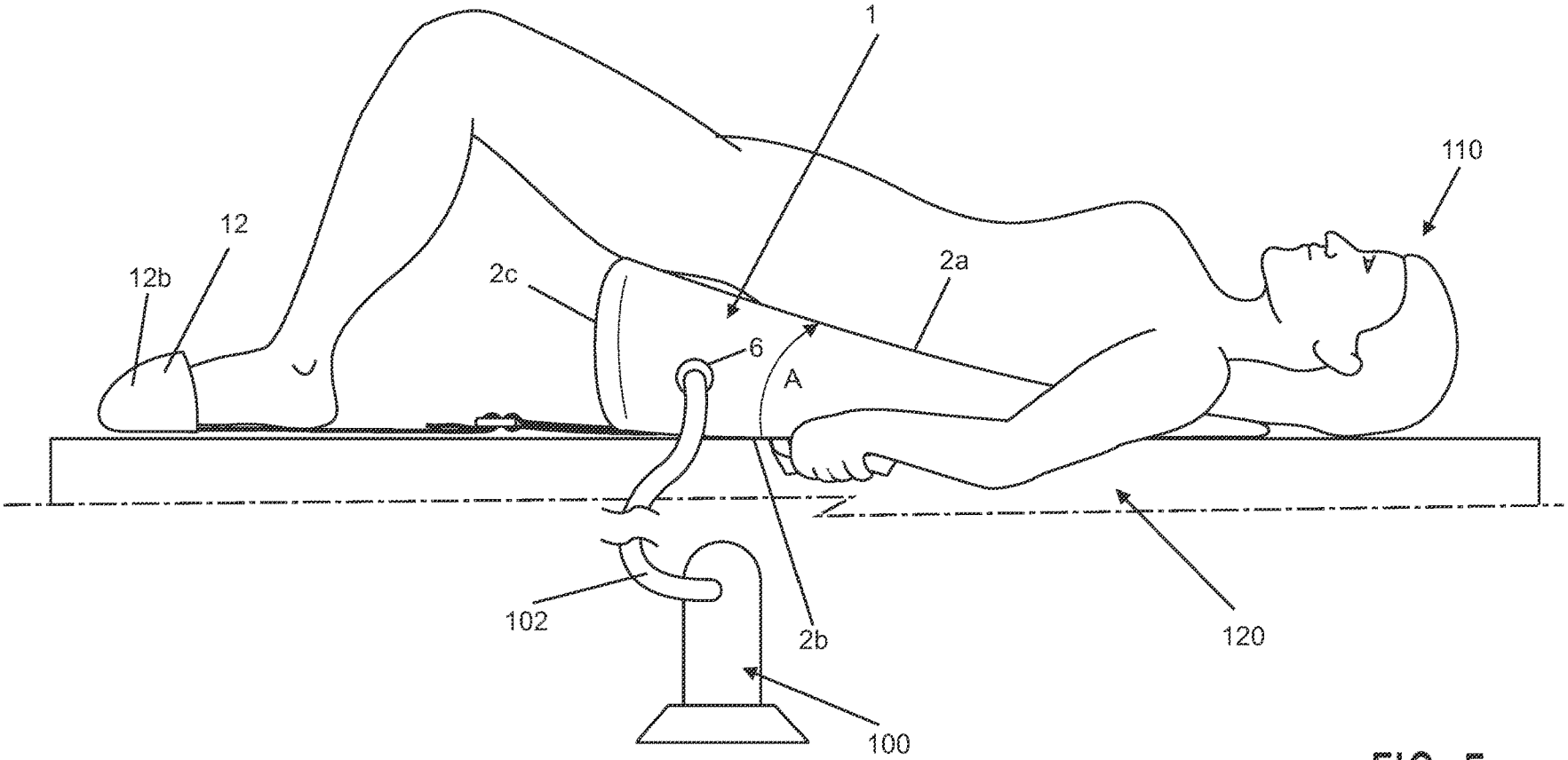
FIG. 5 is a left side view of the pump shown in FIG. 4, and a left side view of the person or human being lying on the apparatus of FIG. 1, which is now shown in an inflated state and which is lying on hospital bed.

FIG. 5 is a left side view of the pump 100 shown in FIG. 4, and a left side view of the person 110 lying on the inflated apparatus 1 of FIG. 1, pelvis tilted up. The apparatus 1 of FIG. 1 which is now shown in an inflated state reposition the person's pelvis to be elevated, and which is lying on the hospital bed or table 120. In the state shown in FIG. 5, the body portion 2 is fully inflated, and the top surface 2*a* is at an angle A of 17.75 degrees with respect to the bottom surface 2*b*.

The transition from FIG. 4 to FIG. 5, by inflating apparatus 1, changes the position and/or orientation of the person 110 by elevating the pelvis. Patient 110's left hand in FIG. 5 is holding onto the left handle 4 of the apparatus 1, the left foot of the person 110 is inside the left foot's straps or stirrups 12 keeping both the knee and the hip in the flexed orientation/position and the person 110 in elevated dorsal lithotomy position.

FIG. 6 is a front view of the apparatus 1 of FIG. 1 in the inflated state, and with the biological person 110 lying on the apparatus 1 of FIG. 1, which is now shown in an inflated state, reposition the person's pelvis to be tilted up/elevated, which is lying on the hospital bed or table 120 and showing body surface 2*c* of the body portion 2 with 2*d*, the concave free space area portion, between 2*e* and 2*f*, allowing the health care provider to perform the exam, the procedure, such as delivery, in a safer manner; and wherein the apparatus 1 of FIG. 1 is connected to the pump 100.

The person 110 in FIG. 6 is shown with the left and right hands holding onto the handles 4 and 5, respectively, of the apparatus 1; and with left and right feet inside stirrups 12 and 13, respectively, keeping both the knee and the hip in the flexed position and/or orientation and the person 110 in elevated dorsal lithotomy position with an elevated pelvis.

Figure 7:
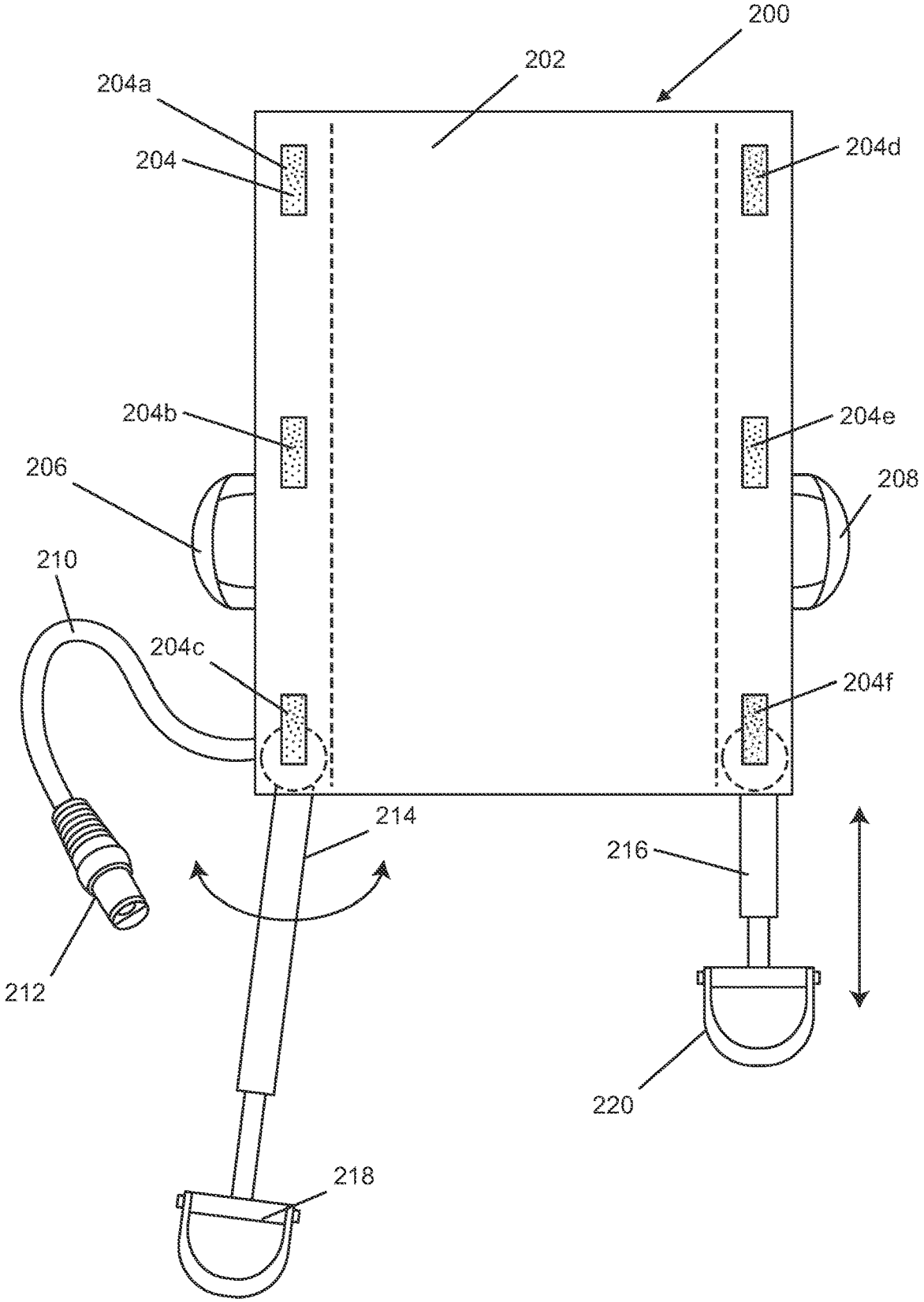
FIG. 7 is a top view of an accessory apparatus's tray, to host the deflated apparatus in FIG. 3, before sliding the apparatus in FIG. 3 underneath the person while lying in supine position as an optional accessory for back support and with light source and feet stirrups.

FIG. 7 is a top view of an accessory apparatus 200. The accessory apparatus 200 is a "reusable tray" with foldable light source and telescopic feet stirrups. The apparatus 200 is an accessory insertion tray. The accessory apparatus 200 works with apparatus 1, but the accessory apparatus 200 is an optional and may be used, to aid in sliding (the single use) apparatus 1 of FIG. 1 underneath the person 110's buttock and lower back and to support the person 110 back while lying on apparatus 1 and the hospital soft mattress bed, however, the apparatus 1 of FIG. 1 can be used without this tray, by sliding the apparatus 1 of FIG. 1 under the person's back without the tray. The accessory apparatus 200 includes Velcro (trademarked), clips, hooks or loop portions or sections 204, including sections 204*a*, 204*b*, 204*c*, 204*d*, 204*e*, and 204*f* attached to a body portion 202. The first accessory apparatus 200 includes a right handle 206, a left handle 208, flexible tube for light or hosting portable light 210, and a light host connector 212. The first further apparatus 200 also includes a right telescopic, retractable foot stirrup 214, a left telescopic/retractable foot stirrup 216, a right stirrup or loop 218, and a left stirrup or loop 220.

The accessory apparatus 200, in at least one embodiment, may be a tray, rectangular flat surface reusable apparatus. The accessory apparatus 200 may be made of hard material, such as stainless steel or hard aluminum, with almost the same dimension in a top view as the top view of the apparatus 1' apparatus in FIG. 2. The accessory apparatus 200 has an underneath groove or tunnel in both right and left side hosting retractable/telescopic right and left stirrups 214, 216 and foldable right and left foot rest 218 and 220, to be hidden when it is not in use. The proximal end part of telescopic stirrups, 214 and 216, at the tray corner, under the location 204*c* and 204*f* has a hidden horizontal joint to allow the particular stirrup, after fully extended, for lateral/horizontal spread up to 45.0 degree, as shown for the right stirrup 214, for the stirrup to spread apart and to allow the person, after resting the feet on the feet rest stirrups 218 and 220, to abduct/spread both thighs apart during the gynecological medical exam and/or procedure. The stirrups 214 and 216, when not in use, are straightened to align with both sides of the accessory apparatus 200; the foot rests 218 and 220 are folded over the stirrups 214 and 216, and then retracted inside the tunnel on both sides of the accessory apparatus 200, to be hidden inside the accessory apparatus 200 after use.

The accessory apparatus 200, in at least one embodiment, may be include built in foldable light source on one side of the tray device or apparatus 200 and extendable/retractable footrest support system (which includes 214, 218, 216, and 220, built into both sides of the device tray or apparatus 200.

The accessory apparatus 200 of FIG. 7 has flexible light source tube holder 210, and light source connector 212 for portable detachable light source. The flexible light tube holder can be hosted inside a groove in the apparatus 200 when it is not in use.

The accessory apparatus 200 of FIG. 7 has left handle 208 and right handle 206 to assist the heath care provider in guiding the accessory apparatus 200 of FIG. 7, after placing the deflated apparatus 1' of FIG. 3, using the Velcro (trademarked) or hooks and/or loops strips 204 for attachment, the handles 206 and 208 to help in sliding both accessory apparatus 200 in FIG. 7 with attached deflated apparatus 1 FIG. 1, or apparatus 1' of FIG. 3 to be slid underneath the person 110. The handles may also be used by the patient to maintain the orientation and/or position of the human patient for stability and to maintain the patient's balance.

The accessory apparatus 200 of FIG. 7 is aimed to support the person 110's back when lying on a hospital bed soft mattress; and to protect the mattress from soiling.

Figure 9:
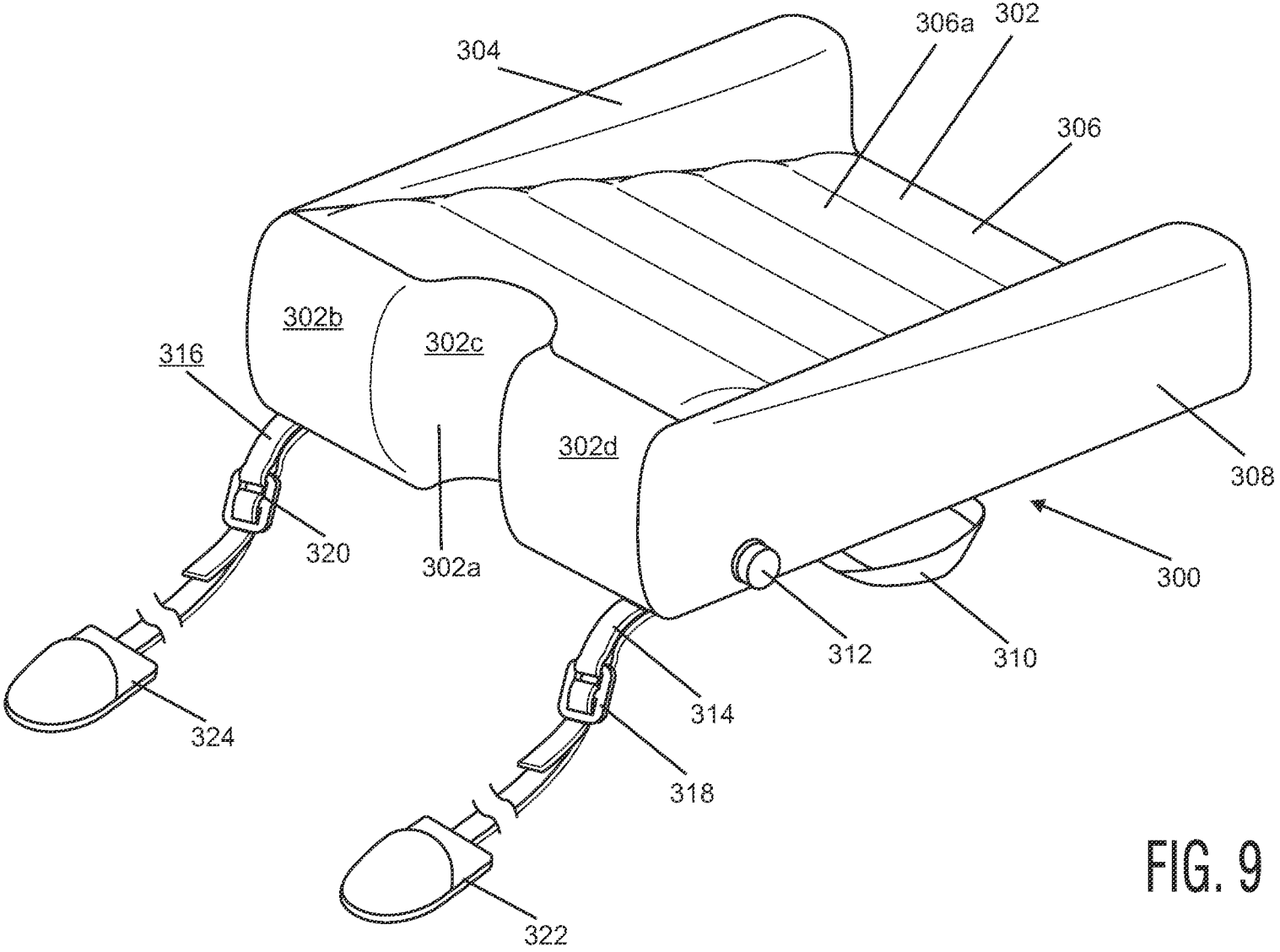
FIG. 9 is a top, front, and left side perspective view of a second modified apparatus in accordance with another embodiment of the present invention, with the second modified apparatus in an inflated state, with the second modified apparatus having side supporting cushions.

When the apparatus 200 of FIG. 7 is used in conjunction with apparatus 1 of FIG. 1 or apparatus 1' of FIG. 3, or apparatus 300 of FIG. 9, the person 110 has the option to use either the straps from apparatus 1, 1', or 300, or the telescopic stirrups of the accessory apparatus 200 in FIG. 7 for leg support.

Figure 8:
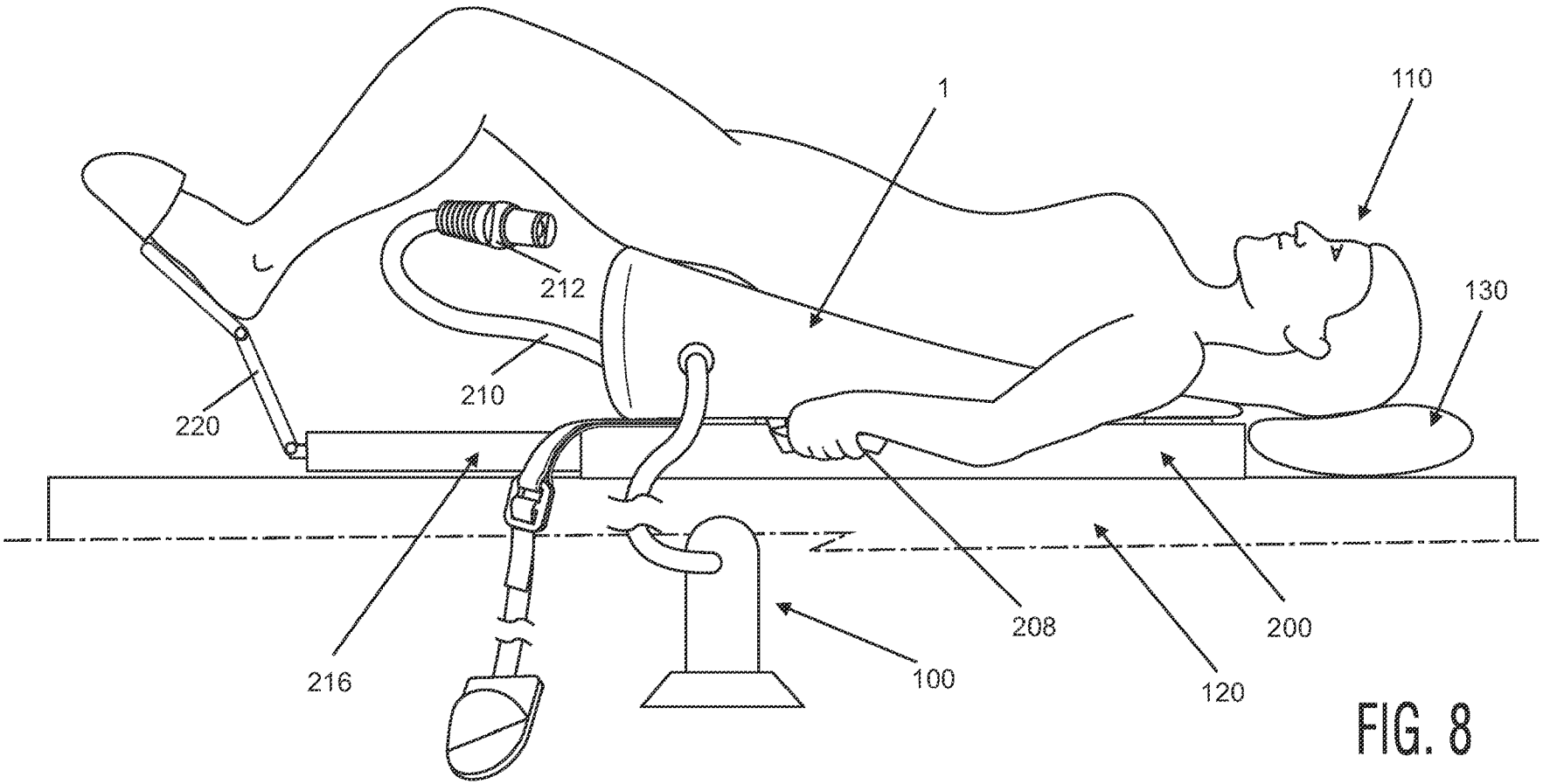
FIG. 8 is a left side view of person 110 lying on the apparatus of FIG. 1, which is in an inflated state; with the accessory apparatus FIG. 7 between the apparatus FIG. 1 and the hospital bed

FIG. 8 is a left side view of the person 110 lying on the apparatus 1 of FIG. 1, which is in an inflated state, lying on the first further apparatus 200, The person 110 shows the head on the regular hospital pillow 130, optional for the person to use for head support, the patient's left leg of the person using the left stirrup 216, FIG. 7, and the left foot of the person resting on the left foot rest 220 in FIG. 7 which is lying on the hospital bed/table 120, and wherein the pump 100 is connected to the apparatus 1.

The person 110's left hand is holding onto the left handle 208 of the apparatus 200. The person 110 as shown in FIG. 8, is now repositioned in dorsal lithotomy position with pelvis tilted up/elevated above the hospital bed mattress/table 120.

The flexible light source tube 210 shown in FIG. 8 with the connected portable detached light through the light connector 212 shown in FIG. 8 directed to the intended area for the gynecological medical exam or procedure.

The apparatus 1 of FIG. 1 or the apparatus 1' of FIG. 2, is above the tray apparatus 200 of FIG. 7, which is above the hospital bed 120. The apparatus 1 of FIG. 1 is above the accessory tray. Apparatus 200 tray of FIG. 7, hosting and underneath the apparatus 1 of FIG. 1 which is in an inflated state. Both, apparatus 1 and 200 above the hospital bed 120, and below the repositioned person 110 and wherein the pump 100 is connected to the apparatus 1 of FIG. 1 or the apparatus 1' of FIG. 2.

The position and/or orientation of the person 110 is changed by elevating the pelvis. Left hand holding onto the left handle 208 of the tray apparatus 200 of FIG. 7; the left foot on the left foot's stirrups 220 of the apparatus tray or accessory apparatus 200 of FIG. 7 keeping both the knee and the hip in the flexed orientation and the person in elevated dorsal lithotomy position.

FIG. 9 is a top, front, and left side perspective view of a second further apparatus 300 in accordance with another embodiment of the present invention, with the second further apparatus 300 in an inflated state. The second further apparatus 300 is similar or identical to the apparatus 1 except as will be described. The apparatus 300 has a body portion 302, which includes a central section 306 between inflatable walls, or cushion supports 304 and 308. The central section 306 has a plurality of ridges 306*a*. The body portion 302 includes a front 302*a*, including sections 302*b*, concave shape 302*c*, and 302*d*. The indented concave section 302*c* is provided to allow space, free area for ease of medical examination similar or identical to indented section 2*d* of the apparatus 1.

The apparatus 300 also includes handle 310 on the left side and a corresponding handle not shown, which is on the right side. The apparatus 300 includes capped input port 312, straps 314, 316, buckles 318, and 320, and stirrups 322 and 324 similar or identical to components shown for apparatus 1.

FIG. 10 is a top, front, and left side perspective view of the human being or person 110, lying on the second further apparatus 300, which is in the inflated state. The back and shoulders of the person 110 are located between the walls/side cushions 304 and 308 to help keep the person 110 from moving on the top surface 306*a* of the central section 306 of the apparatus 300.

The person 110 is supported by the side cushions 304 and 308, with the left hand of the person 110 holding onto the left handle 310 of the apparatus 300, and the right hand holding onto a right handle, similar or identical in structure and position as handle 5 of apparatus 1, and with left and right feet inside feet's straps 322 and 324 keeping both the knee and the hip in the flexed and the person in elevated dorsal lithotomy position with elevated pelvis.

The person 110's left hand holds onto the left handle 310 on the apparatus 300 as shown in FIG. 9. The person 110's left foot, uses the left strap 314, and the left foot is inserted inside the left foot insert stirrups 322 and the uses the right straps 316 with the right foot is inserted inside the right foot insert stirrups 324, as shown in FIG. 10.

FIG. 11 is a top, front, and left (viewed from the patient's perspective) perspective view of an apparatus 400 with multiple bladders in accordance with another embodiment of the present invention, with the apparatus 400 of FIG. 11 shown in an inflated state. The apparatus 400 includes two compartments or bladders 402*a* and 402*b*, which can be filled with air separately through ports 406*a* and 406*b*, each of bladder is shown with a removable cap. This allows for a gradual raising for the position and orientation and to adjust the patient position at desired height.

The body portion 2 may be made of a material typically used for water rafts, such as, but not limited to, any one of polyvinyl chloride (PVC), polyurethane (also called urethane), or Hypalon.

The pump 100 may be connected to the ports 406*a* and 406*b* shown in FIG. 11, through tubes or branches 412 and 416. The tubes or branches 412 and 416 may be connected or branch off from the main tube 410 which is connected to pump 100. There may be shut off valves 414 and 418 provided to prevent or allow the flow of air through the branches or tubes 412 and 416, shown in FIG. 11.

FIG. 12 is a top, front, and left (viewed from the patient's perspective) perspective view of an apparatus 500 in accordance with another embodiment of the present invention, with the apparatus of FIG. 12 shown in an inflated state. The apparatus 500 is the same as the apparatus 1 except as will be described. The apparatus 500 includes a compressed air cartridge 502 which is configured to be activated to fill the body portion 2 with air. The apparatus 500 also includes a safety valve 504 for releasing air from the body portion 502 and allow the air to escape when the pressure exceeds maximum inflation pressure. In addition, the apparatus 500 includes a sleeve 506 which is attached underneath the bottom 2*b* of the body portion 2. A hard board may be inserted into an opening 506*a* of the sleeve 506 and then slid into an inner chamber inside the sleeve of the otherwise closed sleeve 506 so it overlaps all or virtually all of the underneath surface or bottom 2*b* of the body portion 2, to provide support.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. An apparatus comprising:

a body portion having an outer housing and a first inner chamber within the outer housing;

a left foot retaining device attached to the outer housing of the body portion; and a right foot retaining device attached to the outer housing of the body portion; and wherein body portion is configured to allow the first inner chamber to be filled with air to inflate at least part of the body portion; and further comprising a left handle attached to the body portion at a first side of the body portion; and a right handle attached to the body portion at a second side of the body portion which is opposite the first side of the body portion;

an input port configured to receive air into the first inner chamber of the body portion;

wherein the body portion has a front and a rear;

wherein at least part of the body portion is thicker at the front than at the rear when the body portion is fully inflated; and wherein the input port is located on the first side of the body portion, and closer to the front than the left handle; and wherein the body portion is configured to receive air into the first inner chamber through the input port while an individual is lying on their back on a top surface of the body portion with their left hand gripping the left handle.

2. The apparatus of claim 1 wherein the body portion includes a second inner chamber separate from the first inner chamber within the outer housing;

wherein the body portion is configured to receive air into the second inner chamber through an input port while an individual is lying on their back on the top surface of the body portion;

wherein the second inner chamber overlaps the first inner chamber and is above the first inner chamber, when a bottom surface of the body portion lies on a horizontal flat surface;

and wherein each of the first and second inner chambers tapers from a maximum thickness at the front of the body portion to a minimum thickness, if any, at the rear of the body portion.

3. The apparatus of claim 2 further comprising an internal valve between the first inner chamber and the second inner chamber which is configured to open when the first inner chamber is inflated a sufficient amount to allow air into the second inner chamber.

4. The apparatus of claim 1 further comprising:

wherein the body portion is configured to allow the first inner chamber to be filled with air to inflate at least part of the body portion; and wherein the body portion includes a left side wall, a central section, and a right side wall, with the central section in between the left side wall and the right side wall;

wherein the central section has a front, a rear, a top surface, and a bottom surface;

wherein the central section is thicker at the front than at the rear when the body portion is fully inflated;

wherein the left side wall and the right side wall extend outwards above at least part of the top surface of the central section, when the body portion is fully inflated;

wherein the top surface of the central section slopes downwards from the front of the central section to the rear of the central section when the central section is fully inflated and the bottom surface lies on a flat horizontal surface;

wherein the left side wall when fully inflated, gradually extends less above the central section starting from a maximum at the rear of the central section to less of an extension above the central section moving from the rear to the front; and wherein the right side wall when fully inflated, gradually extends less above the central section starting from a maximum at the rear of the central section to less of an extension above the central section moving from the rear to the front.

5. The apparatus of claim 1 wherein the body portion when fully inflated has a wedge shape.

6. The apparatus of claim 1 wherein the front of the body portion when the body portion is fully inflated has an indented section.

7. The apparatus of claim 1 wherein the left foot retaining device is attached to the body portion closer to the front of the body portion than to the rear of the body portion by an adjustable length strap configured to adjust a distance of the left foot retaining device from the front of the body portion; and the right foot retaining device is attached to the body portion by an adjustable length strap configured to adjust a distance of the right foot retaining device from the front of the body portion.

8. The apparatus of claim 1 wherein the left handle includes first and second ends which are attached to the body portion closer to a bottom surface of the body portion than a top surface of the body portion;

wherein there is a loop formed by attachment of the first and second ends of the left handle to the body portion;

wherein the right handle includes first and second ends which are attached to the body portion closer to the bottom surface of the body portion than the top surface of the body portion; and wherein there is a loop formed by attachment of the first and second ends of the right handle to the body portion.

9. The apparatus of claim 1 wherein the body portion is made of a material which is configured to be folded.

10. The apparatus of claim 1 wherein the left foot retaining device is attached to the body portion closer to the front of the body portion than to the rear of the body portion by an adjustment device, wherein the adjustment device of the left foot retaining device adjusts the distance of the left foot retaining device from the front of the body portion by telescoping; and the right foot retaining device is attached to the body portion closer to the front of the body portion than to the rear of the body portion by an adjustment device, wherein the adjustment device of the right foot retaining device adjusts the distance of the right foot retaining device from the body portion by telescoping.

11. The apparatus of claim 1 further comprising a flexible light tube holder configured to be connected at a first end to the body portion closer to the front of the body portion than to the rear of the body portion.

12. The apparatus of claim 1 further comprising a sleeve attached to an underside of the body portion and configured to receive and hold a hard board underneath the body portion which spans a width and a length of the body portion; and wherein the sleeve is closed except for an opening located at the front of the body portion.

13. The apparatus of claim 1 further comprising a cartridge attached to the input port, wherein the cartridge is configured to inflate the body portion.

14. The apparatus of claim 1 further comprising an external safety valve configured to release excess air pressure when air pressure within the first inner chamber of the body portion exceeds a maximum air pressure.

15. The apparatus of claim 1 wherein the apparatus is configured to be disposable.

16. A method comprising the steps of:

locating a body portion of an apparatus in a first location in which the body portion is under the back and buttocks of a person, and between the person and a support structure, while the person is lying down on the body portion, which is located on the support structure; and inflating at least part of the body portion while the body portion is located in the first location; and wherein the apparatus is comprised of:

the body portion which has an outer housing and a first inner chamber within the outer housing;

a left foot retaining device attached to the outer housing of the body portion; and a right foot retaining device attached to the outer housing of the body portion; and and wherein body portion is configured to allow the first inner chamber to be filled with air to inflate at least part of the body portion; and wherein the apparatus is further comprised of:

a left handle attached to the body portion at a first side of the body portion; and a right handle attached to the body portion at a second side of the body portion which is opposite the first side of the body portion;

an input port configured to receive air into the first inner chamber of the body portion;

wherein the body portion has a front and a rear;

wherein the body portion is thicker at the front than at the rear when the body portion is fully inflated; and wherein the input port is located on the first side of the body portion, and closer to the front than the left handle; and wherein the body portion is configured to receive air into the first inner chamber through the input port while an individual is lying on their back on a top surface of the body portion with their left hand gripping the left handle.

17. The method of claim 16 wherein the body portion when fully inflated has a wedge shape.

18. The method of claim 16 wherein the front of the body portion when the body portion is fully inflated has an indented section.

19. The method of claim 16 wherein the left foot retaining device is attached to the body portion closer to the front of the body portion than to the rear of the body portion by an adjustable length strap configured to adjust a distance of the left foot retaining device from the front of the body portion; and the right foot retaining device is attached to the body portion by an adjustable length strap configured to adjust a distance of the right foot retaining device from the front of the body portion.

20. The method of claim 16 wherein the left handle includes first and second ends which are attached to the body portion closer to a bottom surface of the body portion than a top surface of the body portion;

wherein there is a loop formed by attachment of the first and second ends of the left handle to the body portion;

wherein the right handle includes first and second ends which are attached to the body portion closer to the bottom surface of the body portion than the top surface of the body portion; and wherein there is a loop formed by attachment of the first and second ends of the right handle to the body portion.

21. The method of claim 16 wherein

The body portion is made of a material which is configured to be folded.

22. The method of claim 16 wherein the left foot retaining device is attached to the body portion closer to the front of the body portion than to the rear of the body portion by an adjustment device, wherein the adjustment device of the left foot retaining device adjusts the distance of the left foot retaining device from the front of the body portion by telescoping; and wherein the right foot retaining device is attached to the body portion closer to the front of the body portion than to the rear of the body portion by an adjustment device, wherein the adjustment device of the right foot retaining device adjusts the distance of the right foot retaining device from the body portion by telescoping.

23. The method of claim 16 wherein the apparatus further includes a flexible light tube holder configured to be connected at a first end to the body portion closer to the front of the body portion than to the rear of the body portion.

24. The method of claim 16 wherein the apparatus includes a sleeve which is configured to be attached to an underside of the body portion and configured to receive and hold a hard board underneath the body portion which spans a width and a length of the body portion; and wherein the sleeve is closed except for an opening located at the front of the body portion.

25. The method of claim 16 wherein the apparatus includes a cartridge which is attached to the input port, wherein the cartridge is configured to inflate the body portion.

26. The method of claim 16 wherein an external safety valve is provided and is configured to release excess air pressure when air pressure within the first inner chamber of the body portion exceeds a maximum air pressure.

27. The method of claim 16 wherein an internal valve is provided between the first inner chamber and the second inner chamber which is configured to open when the first inner chamber is inflated a sufficient amount to allow air into the second inner chamber.

28. A method comprising locating a body portion of an apparatus in a first location in which the body portion is under the back and buttocks of a person, and between the person and a support structure, while the person is lying down on the body portion, which is located on the support structure; and inflating at least part of the body portion while the body portion is located in the first location; and wherein the apparatus is comprised of:

the body portion having an outer housing and a first inner chamber within the outer housing;

wherein the body portion is configured to allow the first inner chamber to be filled with air to inflate at least part of the body portion; and wherein the body portion includes a left side wall, a central section, and a right side wall, with the central section in between the left side wall and the right side wall;

wherein the central section has a front, a rear, a top surface, and a bottom surface;

wherein the central section is thicker at the front than at the rear when the body portion is fully inflated;

wherein the left side wall and the right side wall extend outwards above at least part of the top surface of the central section, when the body portion is fully inflated;

wherein the top surface of the central section slopes downwards from the front of the central section to the rear of the central section when the central section is fully inflated and the bottom surface lies on a flat horizontal surface;

wherein the left side wall when fully inflated, gradually extends less above the central section starting from a maximum at the rear of the central section to less of an extension above the central section moving from the rear to the front; and wherein the right side wall when fully inflated, gradually extends less above the central section starting from a maximum at the rear of the central section to less of an extension above the central section moving from the rear to the front.

29. The method of claim 28 wherein the apparatus is disposable.

30. A method comprising:

locating a body portion of an apparatus in a first location in which the body portion is under the back and buttocks of a person, and between the person and a support structure, while the person is lying down on the body portion, which is located on the support structure; and inflating at least part of the body portion while the body portion is located in the first location; and wherein the apparatus is comprised of:

the body portion having an outer housing; a first inner chamber within the outer housing; and a second inner chamber separate from the first inner chamber within the outer housing;

wherein the body portion has a front and a rear;

wherein the body portion is configured to receive air into the first inner chamber through an input port while an individual is lying on their back on a top surface of the body portion;

wherein the body portion is configured to receive air into the second inner chamber through an input port while an individual is lying on their back on a top surface of the body portion;

wherein the second inner chamber overlaps the first inner chamber and is above the first inner chamber, when a bottom surface of the body portion lies on a horizontal flat surface;

and wherein each of the first and second inner chambers tapers from a maximum thickness at the front of the body portion to a minimum thickness, if any, at the rear of the body portion.

* * * * *